US008752514B2

(12) United States Patent
Schulze et al.

(10) Patent No.: US 8,752,514 B2
(45) Date of Patent: Jun. 17, 2014

(54) HYDRAULIC VALVE FOR AN OSCILLATING MOTOR ADJUSTER

(75) Inventors: Wolf-Dietmar Schulze, Giessen (DE); Andre Selke, Naumburg (DE)

(73) Assignee: Hilite Germany GmbH, Marktheidenfeld (DE)

( * ) Notice: Subject to any disclaimer, the term of this patent is extended or adjusted under 35 U.S.C. 154(b) by 353 days.

(21) Appl. No.: 13/326,492

(22) Filed: Dec. 15, 2011

(65) Prior Publication Data

US 2012/0152195 A1 Jun. 21, 2012

(30) Foreign Application Priority Data

Dec. 20, 2010 (DE) ..... 10 2010 061 337

(51) Int. Cl.
*F01L 1/34* (2006.01)
*F01L 1/344* (2006.01)

(52) U.S. Cl.
CPC ..... *F01L 1/3442* (2013.01); *F01L 1/34409* (2013.01); *F01L 1/344* (2013.01)
USPC ..... 123/90.17; 123/90.12

(58) Field of Classification Search
CPC ..... F01L 1/3442; F01L 1/344; F01L 2001/34426; F01L 2001/3443; F01L 1/34409
See application file for complete search history.

(56) References Cited

U.S. PATENT DOCUMENTS

| | | | |
|---|---|---|---|
| 699,273 | A | 5/1902 | Wolski |
| 894,286 | A | 7/1908 | Reineking |
| 1,746,855 | A | 2/1930 | French |
| 1,860,163 | A | 5/1932 | Wyzenbeek |
| 2,649,105 | A | 8/1953 | Stout et al. |
| 2,781,059 | A | 2/1957 | Frey |
| 2,918,941 | A | 12/1959 | Whiting |
| 3,779,669 | A | 12/1973 | Sommer |
| 3,783,590 | A | 1/1974 | Allen |
| 3,882,891 | A | 5/1975 | Viles et al. |
| 4,051,864 | A | 10/1977 | Iwatsuki |
| 4,241,758 | A | 12/1980 | Eiermann |
| 4,274,385 | A | 6/1981 | Yuzawa et al. |
| 4,787,345 | A | 11/1988 | Thoma |
| 4,854,649 | A | 8/1989 | Arikawa |
| 5,138,985 | A | 8/1992 | Szodfridt et al. |
| 5,323,806 | A | 6/1994 | Watari et al. |
| 5,645,017 | A | 7/1997 | Melchior |

(Continued)

FOREIGN PATENT DOCUMENTS

| | | |
|---|---|---|
| DE | 2 025 168 | 12/1971 |
| DE | 2 043 002 | 3/1972 |

(Continued)

OTHER PUBLICATIONS

Smith et al., "A Camshaft Torque Actuated Vane Style VCT Phaser", pp. 43-50 (SAE International, Jan. 2005).

(Continued)

*Primary Examiner* — Thomas Denion
*Assistant Examiner* — Daniel Bernstein
(74) *Attorney, Agent, or Firm* — Lipsitz & McAllister, LLC

(57) ABSTRACT

The invention relates to a hydraulic valve for an oscillating motor adjuster that utilizes camshaft alternating torques by means of non-return valves for more rapid adjustment. The non-return valve that is not used for the respective rotation is additionally closed by means of the piston of the hydraulic valve.

16 Claims, 4 Drawing Sheets

(56) References Cited

U.S. PATENT DOCUMENTS

| | | | | |
|---|---|---|---|---|
| 5,657,725 | A | 8/1997 | Butterfield et al. | |
| 6,024,061 | A | 2/2000 | Adachi et al. | |
| 6,035,819 | A | 3/2000 | Nakayoshi et al. | |
| 6,053,139 | A | 4/2000 | Eguchi et al. | |
| 6,058,897 | A | 5/2000 | Nakayoshi | |
| 6,085,708 | A | 7/2000 | Trzmiel et al. | |
| 6,209,497 | B1 | 4/2001 | Niethammer et al. | |
| 6,234,125 | B1 | 5/2001 | Neubauer et al. | |
| 6,267,041 | B1 | 7/2001 | Skiba et al. | |
| 6,408,807 | B1 | 6/2002 | Komazawa et al. | |
| 6,453,859 | B1 | 9/2002 | Smith et al. | |
| 6,532,921 | B2 | 3/2003 | Sato et al. | |
| 6,739,297 | B2 | 5/2004 | Palesch et al. | |
| 6,763,791 | B2 | 7/2004 | Gardner et al. | |
| 6,814,036 | B2 | 11/2004 | Palesch et al. | |
| 6,820,578 | B2 | 11/2004 | Kanada et al. | |
| 6,845,740 | B2 | 1/2005 | Kohrs | |
| 6,883,481 | B2 * | 4/2005 | Gardner et al. | 123/90.17 |
| 6,899,126 | B2 | 5/2005 | Weigand et al. | |
| 6,941,912 | B2 | 9/2005 | Palesch et al. | |
| 6,968,815 | B2 | 11/2005 | Palesch et al. | |
| 7,011,059 | B2 | 3/2006 | Plank et al. | |
| 7,121,553 | B2 | 10/2006 | Cornea et al. | |
| 7,124,722 | B2 | 10/2006 | Smith | |
| 7,198,013 | B2 | 4/2007 | Palesch et al. | |
| 7,219,636 | B2 | 5/2007 | Sawada | |
| 7,240,768 | B2 | 7/2007 | Sageman | |
| 7,318,401 | B2 * | 1/2008 | Pluta et al. | 123/90.17 |
| 7,331,318 | B2 | 2/2008 | Schweizer | |
| 7,387,097 | B2 | 6/2008 | Schmitt et al. | |
| 7,444,971 | B2 | 11/2008 | Suga et al. | |
| 7,513,230 | B2 | 4/2009 | Knecht et al. | |
| 7,533,695 | B2 | 5/2009 | Strauss et al. | |
| 7,584,728 | B2 | 9/2009 | Berndorfer | |
| 7,600,531 | B2 | 10/2009 | Patze et al. | |
| 7,681,542 | B2 | 3/2010 | Paul et al. | |
| 7,836,857 | B2 | 11/2010 | Knecht et al. | |
| 7,866,289 | B2 | 1/2011 | Grunow et al. | |
| 7,946,266 | B2 | 5/2011 | Knecht et al. | |
| 7,987,827 | B2 | 8/2011 | Fujiyoshi et al. | |
| 8,225,818 | B1 | 7/2012 | Stephens et al. | |
| 8,505,582 | B2 * | 8/2013 | Gautier et al. | 137/625.68 |
| 2002/0062803 | A1 | 5/2002 | Sato et al. | |
| 2002/0088413 | A1 | 7/2002 | Smith et al. | |
| 2002/0088417 | A1 | 7/2002 | Palesch et al. | |
| 2003/0033999 | A1 | 2/2003 | Gardner et al. | |
| 2003/0070713 | A1 | 4/2003 | Cornea et al. | |
| 2003/0116110 | A1 | 6/2003 | Kohrs | |
| 2003/0177991 | A1 | 9/2003 | Palesch et al. | |
| 2004/0112314 | A1 | 6/2004 | Kanada et al. | |
| 2004/0211379 | A1 | 10/2004 | Palesch et al. | |
| 2004/0244852 | A1 | 12/2004 | Cornea et al. | |
| 2005/0051123 | A1 | 3/2005 | Haser et al. | |
| 2005/0056245 | A1 | 3/2005 | Plank et al. | |
| 2005/0072397 | A1 | 4/2005 | Sluka et al. | |
| 2005/0241603 | A1 | 11/2005 | Palesch et al. | |
| 2005/0252561 | A1 | 11/2005 | Strauss et al. | |
| 2005/0257762 | A1 | 11/2005 | Sawada | |
| 2006/0201463 | A1 | 9/2006 | Schweizer | |
| 2006/0225791 | A1 | 10/2006 | Patze et al. | |
| 2007/0074687 | A1 | 4/2007 | Bosl-Flierl et al. | |
| 2007/0266971 | A1 | 11/2007 | Bosl-Flierl et al. | |
| 2008/0115751 | A1 | 5/2008 | Knecht et al. | |
| 2008/0149056 | A1 | 6/2008 | Grunow | |
| 2008/0149057 | A1 | 6/2008 | Grunow et al. | |
| 2009/0020178 | A1 | 1/2009 | Stallmann | |
| 2009/0056656 | A1 | 3/2009 | Strauss | |
| 2009/0057588 | A1 | 3/2009 | Reilly | |
| 2009/0071140 | A1 | 3/2009 | Knecht et al. | |
| 2009/0071426 | A1 | 3/2009 | Knecht et al. | |
| 2009/0133652 | A1 | 5/2009 | Fujyoshi et al. | |
| 2009/0159024 | A1 | 6/2009 | Paul et al. | |
| 2009/0159829 | A1 | 6/2009 | Hoppe et al. | |
| 2009/0241878 | A1 | 10/2009 | Yamaguchi | |
| 2010/0037841 | A1 | 2/2010 | Strauss et al. | |
| 2010/0199936 | A1 | 8/2010 | Weiss et al. | |
| 2010/0269772 | A1 | 10/2010 | Takemura et al. | |
| 2010/0288215 | A1 | 11/2010 | Takemura et al. | |
| 2010/0300388 | A1 | 12/2010 | Lang et al. | |
| 2010/0326385 | A1 | 12/2010 | Busse | |
| 2011/0094464 | A1 | 4/2011 | Eimert | |
| 2011/0139100 | A1 | 6/2011 | Busse et al. | |
| 2011/0162603 | A1 | 7/2011 | Busse | |
| 2011/0247576 | A1 * | 10/2011 | Knecht et al. | 123/90.17 |
| 2011/0266479 | A1 | 11/2011 | Gautier et al. | |
| 2011/0309281 | A1 * | 12/2011 | Hoppe et al. | 251/324 |

FOREIGN PATENT DOCUMENTS

| | | |
|---|---|---|
| DE | 36 01 643 | 7/1987 |
| DE | 38 29 698 | 3/1989 |
| DE | 42 10 580 | 10/1993 |
| DE | 42 35 929 | 4/1994 |
| DE | 44 22 742 | 1/1996 |
| DE | 195 25 837 | 1/1997 |
| DE | 199 14 156 | 10/1999 |
| DE | 199 18 910 | 11/1999 |
| DE | 198 23 619 | 12/1999 |
| DE | 198 44 669 | 3/2000 |
| DE | 198 47 705 | 4/2000 |
| DE | 198 53 670 | 5/2000 |
| DE | 199 52 275 | 5/2000 |
| DE | 100 50 225 | 4/2002 |
| DE | 101 58 530 | 8/2002 |
| DE | 101 61 698 | 6/2003 |
| DE | 101 61 701 | 6/2003 |
| DE | 102 05 415 | 8/2003 |
| DE | 102 11 467 | 9/2003 |
| DE | 102 28 354 | 1/2004 |
| DE | 103 44 816 | 5/2004 |
| DE | 103 30 449 | 2/2005 |
| DE | 103 34 690 | 3/2005 |
| DE | 103 44 916 | 4/2005 |
| DE | 60201949 | 4/2005 |
| DE | 103 46 448 | 6/2005 |
| DE | 10 2004 038 252 | 12/2005 |
| DE | 10 2005 023 056 | 12/2005 |
| DE | 10 2005 004 281 | 1/2006 |
| DE | 10 2005 013 085 | 1/2006 |
| DE | 10 2004 035 007 | 2/2006 |
| DE | 602 07 308 | 3/2006 |
| DE | 10 2004 039 800 | 5/2006 |
| DE | 10 2005 034 275 | 1/2007 |
| DE | 10 2005 034 276 | 1/2007 |
| DE | 10 2006 012 733 | 9/2007 |
| DE | 10 2006 012 775 | 9/2007 |
| DE | 10 2007 012 967 | 9/2008 |
| DE | 10 2006 036 052 | 12/2008 |
| DE | 10 2007 040 017 | 2/2009 |
| DE | 10 2007 041 552 | 3/2009 |
| DE | 10 2007 053 688 | 5/2009 |
| DE | 10 2008 005 277 | 7/2009 |
| DE | 10 2009 022 869 | 12/2010 |
| DE | 10 2009 035 233 | 3/2011 |
| DE | 10 2009 050 779 | 8/2011 |
| EP | 0 069 531 | 1/1983 |
| EP | 0 245 791 | 11/1987 |
| EP | 0 388 244 | 9/1990 |
| EP | 0 799 976 | 10/1997 |
| EP | 0 799 977 | 10/1997 |
| EP | 0 821 138 | 1/1998 |
| EP | 0 834 655 | 4/1998 |
| EP | 0 859 130 | 8/1998 |
| EP | 0 896 129 | 2/1999 |
| EP | 0 924 393 | 6/1999 |
| EP | 1 008 729 | 6/2000 |
| EP | 1 197 641 | 4/2002 |
| EP | 1 291 563 | 3/2003 |
| EP | 1 347 154 | 9/2003 |
| EP | 1 447 602 | 8/2004 |
| EP | 1 475 518 | 11/2004 |
| EP | 1 477 636 | 11/2004 |
| EP | 1 703 184 | 9/2006 |
| EP | 1 476 642 | 1/2008 |

(56) References Cited

FOREIGN PATENT DOCUMENTS

| | | |
|---|---|---|
| EP | 2 093 388 | 8/2009 |
| FR | 525 481 | 9/1921 |
| FR | 996 121 | 12/1951 |
| GB | 1 212 327 | 11/1970 |
| GB | 2 161 583 | 1/1986 |
| JP | 55-72965 | 6/1980 |
| JP | 57-13094 | 1/1982 |
| WO | 99/67537 | 12/1999 |
| WO | 03/078804 | 9/2003 |
| WO | 2004/088094 | 10/2004 |
| WO | 2004/088099 | 10/2004 |
| WO | 2008/140897 | 11/2008 |
| WO | 2010/040617 | 4/2010 |

OTHER PUBLICATIONS

Pohl, Dirk, et al., "Vanecam® FastPhaser-Camphasing System for Improvement of Phasing Rate and Reduction of Oil Consumption", Konfernz Haus der Technik Variable Ventilsteuerung, 17 pages, Feb. 2007.

* cited by examiner

HYDRAULIC VALVE FOR AN OSCILLATING MOTOR ADJUSTER

This application claims the benefit of German patent application no. DE 10 2010 061 337.1 filed on Dec. 20, 2010, which is incorporated herein and made a part hereof by reference for all purposes.

BACKGROUND OF THE INVENTION

The invention relates to a hydraulic valve for an oscillating motor adjuster that utilizes camshaft alternating torques by means of non-return valves for more rapid adjustment.

An oscillating motor adjuster having a hydraulic valve with which camshaft alternating torques can be utilized for more rapid adjustment is already known from DE 10 2006 012 733 B4 and DE 10 2006 012 775 B4. For this purpose, pressure peaks caused by camshaft alternating torques are conducted from each of the pressure chambers of the oscillating motor adjuster to be discharged via a non-return valve into the flow of the oil pump. Thus, additional volume is provided for the pressure chamber to be filled, in addition to the normal flow volume of the oil pump. In order to make possible a more rapid adjustment in both oscillating directions, a non-return valve is provided for each of the oscillating directions. Structurally, the hydraulic valve has two working ports for this purpose. These two working ports each have a standard port part axially adjacent to one another and a port part for utilizing pressure peaks as a consequence of camshaft alternating torques. The hydraulic pressure can be introduced from a supply port to the working port that is to be loaded, whereas the working port that is to be relieved of pressure is guided to a tank port.

In order to also maintain the adjusting capacity in the case of internal combustion engines with very greatly fluctuating camshaft alternating torques, DE 10 2010 014 500.9, which has not been pre-published, proposes that one switching position of the hydraulic valve can be controlled proportionally, in which the pressure peaks of the working port to be relieved of pressure are blocked relative to the supply port and the working port that is to be loaded.

DE 102 11 467 A1 relates to a central valve that takes over the function of a so-called central screw and clamps the rotor against the camshaft. Thus, as a disadvantage, stresses occur in the hydraulic valve.

A hydraulic valve for an oscillating motor adjuster is already known from EP 1 476 642 B1, which has two hollow pistons that support each other via a flat spiral spring. A gap can be opened and closed therewith between the two pistons.

The problem to be solved by the present invention is to create an oscillating motor adjuster that has a high adjusting capacity despite a high adjusting speed with a low oil pump pressure.

SUMMARY OF THE INVENTION

This problem is solved according to the invention by utilizing non-return valves, with which camshaft alternating torques can be utilized for rapid adjustment or for adjustment with low oil pressure, in the hydraulic valve of the oscillating motor adjuster. The oil pressure is very small, for example, if many consumers exit from the hydraulic circuit or if the oil pump is dimensioned very small for reducing fuel consumption. Such low pressures may lie below 1 bar.

This hydraulic concept for more rapid camshaft adjustment by means of non-return valves, which is also presented in DE 10 2006 012 733 B4 and DE 10 2006 012 775 B4, in principle functions better, the higher the oil pump pressure is, the stronger the camshaft alternating torques are, the tighter the non-return valves are, and the smaller the prestressing of these non-return valves is.

With increasing prestressing, the pressure necessary for opening the non-return valve also increases. The tightness, however, is related to the prestressing, so that here an optimizing process is necessary. The quality and thus the costs of the electromagnetic actuator for displacement of the piston still play a role in this optimizing process, since with an increasing proportion of camshaft alternating torques utilized, the requirements increase for the controllability of the hydraulic valve or of its controlling electronics. The smaller the number of cylinders per camshaft (i.e., per cylinder bank) is, the stronger the camshaft alternating torques become. Thus, the present invention can display its advantage to a particular extent in three-cylinder engines and six-cylinder engines in a V-arrangement.

According to the invention, the piston is designed in such a way that, in the case of DE 10 2006 012 733 B4 and DE 10 2006 012 775 B4, without anything further, it further closes the already closed non-return valves of the working port A or B that is to be pressure-loaded due to the supply pressure. It should be appreciated that the term "closing" is also meant to encompass, in addition to a complete closure, a state that allows only a minimum flow volume via control edges into the annular space in which the strip-shaped non-return valve is installed.

In this case, however, the non-return valve need not be designed as a strip-shaped non-return valve, which is installed in an annular space or an annular groove of the hydraulic valve. For example, it is also possible to design the non-return valve as a ball-check valve in a funnel-shaped valve seat, as such a ball-check valve is already known from DE 10 2007 012 967 B4.

The non-return valve, however, need not act radially. It is also possible to design the non-return valve to act axially.

The method according to the invention can find use in a particularly advantageous way for both oscillating directions of the camshaft adjustment. It is also possible, however, to apply the method according to the invention to only one of the directions of rotation and to provide a compensation spring in the other direction of rotation.

According to one advantage of the invention, the hydraulic valve of the oscillating motor adjuster is designed as a central valve. Such a central valve has advantages relative to structural space. In addition to central valves, there are also decentralized or external hydraulic valves for actuating the oscillating motor adjuster. In the case of the external hydraulic valve, the hydraulic channels for the camshaft adjustment run from the oscillating-motor camshaft adjuster to a separate timing gear cover with the hydraulic valve screwed therein or, alternatively, to the cylinder head having the hydraulic valve screwed therein. Conduction losses accompany the hydraulic lines from the oscillating motor adjuster to the external hydraulic valve. The controls from the external hydraulic valve are also not as dynamically reactive as in the case of the central valve. The hydraulic central valve is also radially disposed within the rotor hub of the oscillating motor adjuster.

If the hydraulic valve is designed as a central valve, then the axial fixation of the hydraulic valve opposite the camshaft can be designed as separate from the axial bracing of the rotor against the camshaft. In comparison to central valves, which are also central screws, this makes possible a large play in the configuration without taking into consideration structural mechanical problems. Therefore, high-strength material need not be used. For example, light metal, in particular aluminum, can be applied as the material. Also, hydraulic control edges can be accurately designed on the central valve. Sealing rings, in particular O rings, for bridging the gap can be dispensed with. Since a large screw head on the central valve is not necessary, the central valve can be manufactured with a relatively uniform outer diameter, so that only a relatively small amount of material needs to be used, which makes the central valve cost-effective. In order to join the rotor to the camshaft in a torsionally rigid manner, the rotor can be welded on or can be pressed on with a micro-serration. In one possible configuration, it is also possible to clamp the rotor axially with a nut against a shoulder on the camshaft. The nut can thus be screwed onto an outer thread at the end of the camshaft. The nut keeps the central valve free from stresses.

In a further possible configuration, the piston is completely pressure-equilibrated.

The camshaft can be designed in particular as a built-in camshaft. Such built-in camshafts comprise a hollow tube, onto which the cams are shrunk-fit. These built-in camshafts are cost-effective and lightweight.

In one example embodiment of the invention, the hydraulic valve is inserted as a central valve inside the rotor. Thus, since the paths between the hydraulic valve and the pressure chambers are very short, such a hydraulic valve has advantages in its effectiveness and dynamics. Advantages relative to structural space are also achieved. If the central valve is designed as a central screw, it must be dimensioned appropriately, in order to take up the stresses for clamping the rotor. With the present invention, the central valve may also be inserted inside the rotor if the camshaft lies in between as a hollow shaft.

In a further example embodiment of the invention, recesses that have several functions for conducting the hydraulic fluid are provided in the displaceable piston. The recesses conduct the hydraulic fluid from a supply channel inside the piston into the working chambers. These recesses also conduct pressure peaks that result from camshaft alternating torques from the working chambers into the supply channel. These recesses, however, are not provided for discharge of hydraulic fluid to the tank outlet. These recesses may have annular grooves, for example, so that the piston does not need to be oriented at an angle opposite the borehole or the bush. Such an annular groove for the distribution of the hydraulic fluid over the periphery, however, can also be worked into the inside wall of the bush.

Additional advantages of the invention may be derived from the patent claims, the description and the drawing.

BRIEF DESCRIPTION OF THE DRAWINGS

The present invention will hereinafter be described in conjunction with the appended drawing figures, wherein like reference numerals denote like elements, and.

DETAILED DESCRIPTION

Figure 1:
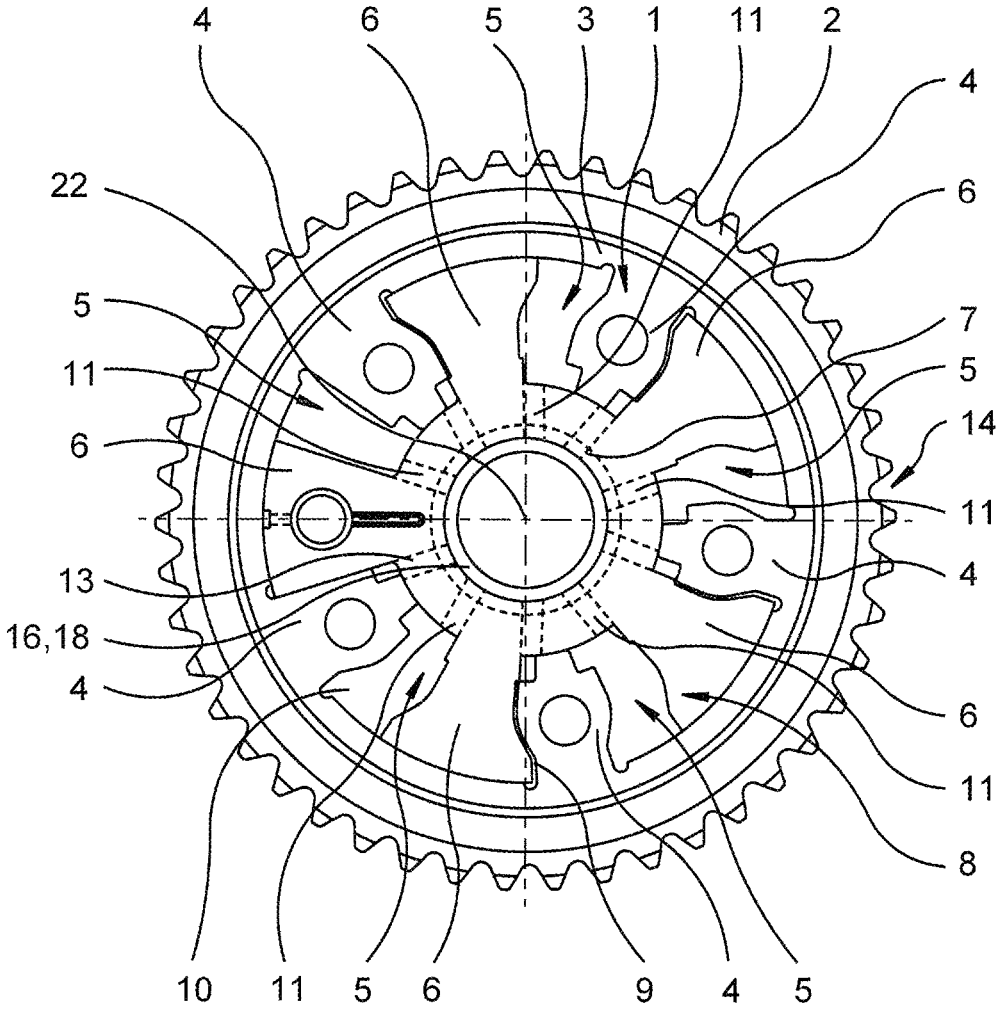
FIG. 1 shows an example embodiment of oscillating motor adjuster in accordance with the present invention in a cutaway view.

The angular position of a camshaft 18 can be continuously changed relative to a drive wheel 2 with an oscillating motor adjuster 14 according to FIG. 1 during the operation of an internal combustion engine. By rotating camshaft 18, the opening and closing time points of the gas exchange valves are shifted so that the internal combustion engine offers its optimal performance at the speed involved. The oscillating motor adjuster 14 has a cylindrical stator 1, which is joined in a torsionally rigid manner to drive wheel 2. In the example embodiment shown in FIG. 1, drive wheel 2 is a chain wheel, by means of which a chain, which is not shown in more detail, is guided. Drive wheel 2, however, may also be a toothed belt gear by means of which a drive belt is guided as a drive element. Stator 1 is drive-connected to the crankshaft by means of this drive element and drive wheel 2.

Figure 2:
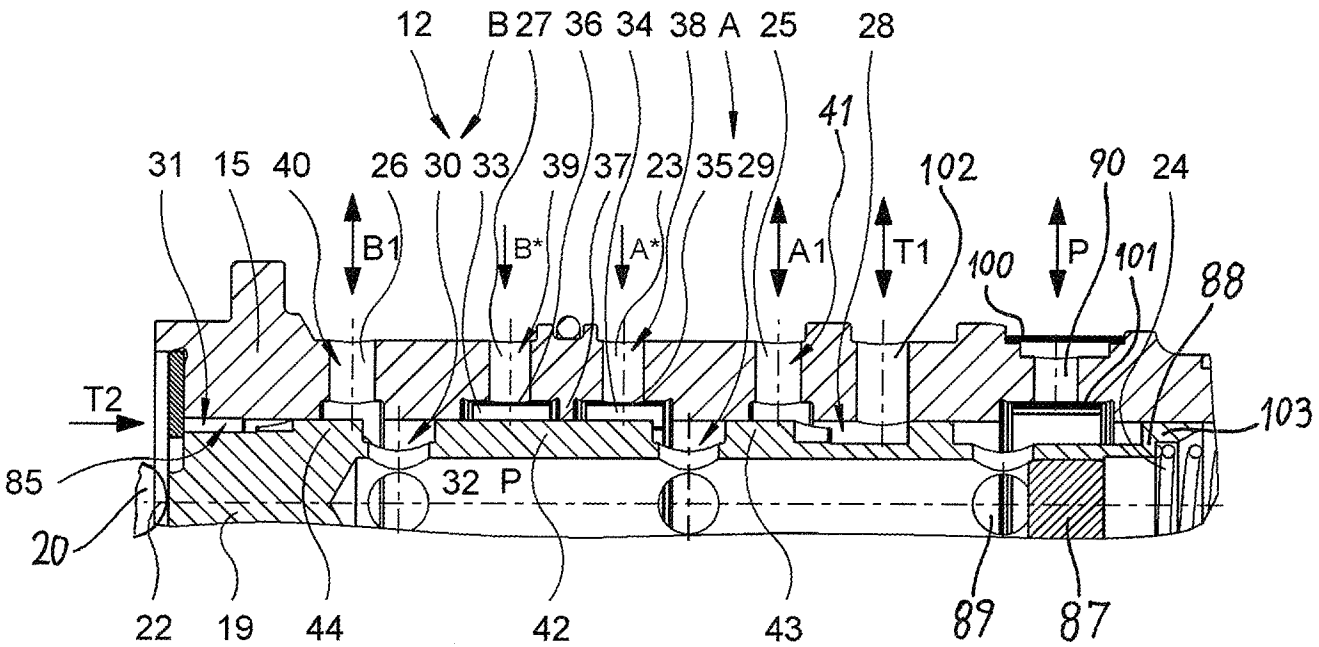
FIG. 2 shows in a half-section an example embodiment of a hydraulic valve for adjusting the oscillating motor adjuster according to FIG. 1.

Stator 1 comprises a cylindrical stator base 3, on the inner side of which webs 4 protrude radially toward the inside at equal distances. Intermediate spaces 5 into which pressure medium is introduced via a hydraulic valve 12, which is shown in further detail in FIG. 2, are formed between adjacent webs 4. Hydraulic valve 12 is therefore designed as a central valve. Vanes 6, which protrude radially toward the outside from a cylindrical rotor hub 7 of a rotor 8, project between adjacent webs 4. These vanes 6 subdivide the intermediate spaces 5 between webs 4 into two pressure chambers 9 and 10.

Webs 4 are applied tightly by their front sides to the outer jacket surface of rotor hub 7. Vanes 6 in turn are applied tightly by their front sides to the cylindrical inner wall of stator base 3.

Rotor 8 is joined to camshaft 18 in a torsionally rigid manner. In order to change the angular position between camshaft 18 and drive wheel 2, rotor 8 is rotated relative to stator 1. For this purpose, depending on the desired direction of rotation each time, the pressure medium in pressure chambers 9 or 10 is pressurized, while the other pressure chambers 10 or 9 are relieved of pressure toward the tank. In order to oscillate or pivot rotor 8 opposite stator 1 in a counterclockwise direction into the position shown, an annular first rotor channel in rotor hub 7 is pressurized by hydraulic valve 12. Other channels 11 then lead from this first rotor channel into pressure chambers 10. This first rotor channel is assigned to the first working port A. In order to pivot rotor 8, in contrast, in the clockwise direction, a second annular rotor channel in rotor hub 7 is pressurized by hydraulic valve 12. This second rotor channel is assigned to the second working port B. These two rotor channels are disposed axially distanced from one another relative to a central axis 22.

Oscillating motor adjuster 14 is placed on built-in camshaft 18 designed as a hollow tube 16. For this purpose, rotor 8 is plugged onto camshaft 18. Oscillating motor adjuster 14 can be pivoted by means of hydraulic valve 12 shown in FIG. 2.

A bush 15 belonging to hydraulic valve 12 is coaxially inserted inside hollow tube 16. A hollow piston 19 is guided in a displaceable manner into central borehole 85 of this bush 15 against the force of a screw-type pressure spring 24. For this purpose, screw-type pressure spring 24 is supported on piston 19 on one side and is fixed in the housing on the other side. A shoulder 88 to which a radial spring guide piece 103 is connected near the end of piston 19 is provided inside piston 19 for supporting screw-type pressure spring 24.

A tappet 20 of an electromagnetic actuator is applied to piston 19 on the outer side (i.e., the back end) of bush 15 of the camshaft.

Hollow piston 19 has four circumferential control grooves 28, 29, 30, and 31 that are axially distanced from one another. In addition, four recesses 41, 38, 39, 40 that are axially distanced from one another are provided in bush 15. The axially outermost recesses 41, 40 are designed as through-boreholes 25, 26. The axially inner recesses 38, 39, in contrast, are each formed from a pair composed of one through-borehole 23, 27 and one inner annular groove 34, 33.

Thus, so-called control edges are formed between control grooves 28, 29, 30, 31 and the abutting recesses 41, 38, 39, 40. The quantity of hydraulic fluid that is conducted through is determined by these control edges, whereby the flow of hydraulic fluid can be nearly completely blocked at these control edges with an appropriately large coverage. Thus a gap seal is formed between piston 19 and bush 15 with blocked control edges.

The two front recesses 41, 38 are assigned to the first working port A. The two rear recesses 39, 40 are assigned to the second working port B. The frontmost working port A is divided into two port parts A1, A*. The rear working port B is also divided into two port parts B1, B*.

The first (i.e., frontmost) recess 41 is provided for the first port part A1 and for conducting hydraulic fluid into the pressure chambers 9 of the oscillating motor adjuster that are assigned to one oscillating direction. In addition, hydraulic fluid can also be transported to a first tank outlet T1 via this first port part A1.

The second recess 38 is provided for the second port part A* and for conducting hydraulic fluid out from these pressure chambers 9 to a supply channel 32 disposed inside piston 19. This outward conduction results when the pressure in these pressure chambers 9 increases correspondingly as a consequence of camshaft alternating torques.

The third recess 39 is provided for the second port part B* of the second working port B and for conducting hydraulic fluid out from pressure chambers 10 to supply channel 32. This outward conduction results when the pressure in these pressure chambers 10 increases correspondingly as a consequence of camshaft alternating torques.

The fourth (i.e., rearmost) recess 40 is provided for the first port part B1 of the second working port B and for guiding hydraulic fluid into pressure chambers 10. In addition, hydraulic fluid can also be transported from pressure chambers 10 to a second tank outlet T2 via this port part B1.

The two axially central ports A*, B* each have a strip-shaped non-return valve 35 or 36. The front non-return valve 35 is inserted into the encircling inner annular groove 34 annularly inside bush 15 radially inside the through-borehole 23 of port A*. In contrast, the rear non-return valve 36 is inserted into the encircling inner annular groove 33 annularly inside bush 15 inside the through-borehole 27 of port B*. Both non-return valves 35, 36 open independently of one another against slight excess pressure from outside. For this purpose, both non-return valves 35, 36 are separated from one another by means of a web 37, which projects radially toward the inside and which has a very small gap seal relative to a very wide web 42 of piston 19.

On the two axial ends of this wide web 42 abut the control grooves 29, 30, which are bounded by means of radially outward projecting webs 43, 44 against the control grooves 28, 31 assigned to the tank outlets T1, T2. These two control grooves 28, 31 each lead to a tank outlet T1 or T2, when piston 19 is found in the corresponding position.

The position in which piston 19 is found fully in back is shown in FIG. 2. In this case, the second working port B is supplied with hydraulic pressure by central supply channel 32 inside piston 19. In return, the hydraulic fluid from the pressure chambers 9 assigned to the first working port A is discharged via control groove 28 to the front tank outlet T1, which has cross boreholes 102 for this purpose in bush 15. If the pressure increases abruptly within these pressure chambers 9 as a consequence of camshaft alternating torques to above the pressure inside supply channel 32, then the front non-return valve 35 opens and the hydraulic pressure from pressure chambers 9 can be fed into supply channel 32. From there, the hydraulic fluid along with the hydraulic fluid coming from the oil pump are fed into the second working port B. Its second port part B* in this case is closed by the wide web 42. Thus, non-return valve 36 is blocked by the internal pressure.

If piston 19 is shifted by means of tappet 20 of the electromagnetic actuator into the other end position, then the hydraulic fluid is conducted to the first working port A. In this way, the hydraulic fluid flows from supply channel 32 via control groove 29 into recess 37 and then to the first working port A. In return, the hydraulic fluid is discharged from pressure chambers 10 assigned to the second port B via control groove 31 to the rear tank outlet T1. If the pressure increases abruptly within pressure chambers 10 as a consequence of camshaft alternating torques to above the pressure inside supply channel 32, then the rear non-return valve 36 opens and the hydraulic pressure from these pressure chambers 10 can be fed into supply channel 32. From there, the hydraulic fluid along with the hydraulic fluid coming from the oil pump is fed into the first port part A1 of the first working port A. The second port part A* of the first working port A in this case is closed by the wide web 42.

In addition, piston 19 can still be adjusted in a central blocking position in which both working ports A, B can be pressurized to a greater extent than the hydraulic fluid can be discharged. Thus, oscillating motor adjuster 14 is fixed in this angular position.

Hydraulic valve 12 has a radial supply port P, which conducts the hydraulic fluid at the front end of piston 19 through an opening 89 into the central supply channel 32 inside piston 19. For this purpose, cross boreholes 90 are provided on this front end in bush 15, and the hydraulic fluid is introduced into these boreholes via a sieve 100. From cross boreholes 90 to openings 89, the hydraulic fluid is conducted through a non-return valve 101, which blocks pressure peaks inside supply channel 32 in hydraulic valve 12 toward supply port P. A stopper 87, which closes piston 19 at the front end, is adjacent to openings 89 inside hollow piston 19.

Alternatively, it is also possible to place supply port P on the side of tappet 20. Configurations with axial introduction of supply port P may also be created.

Figure 3:
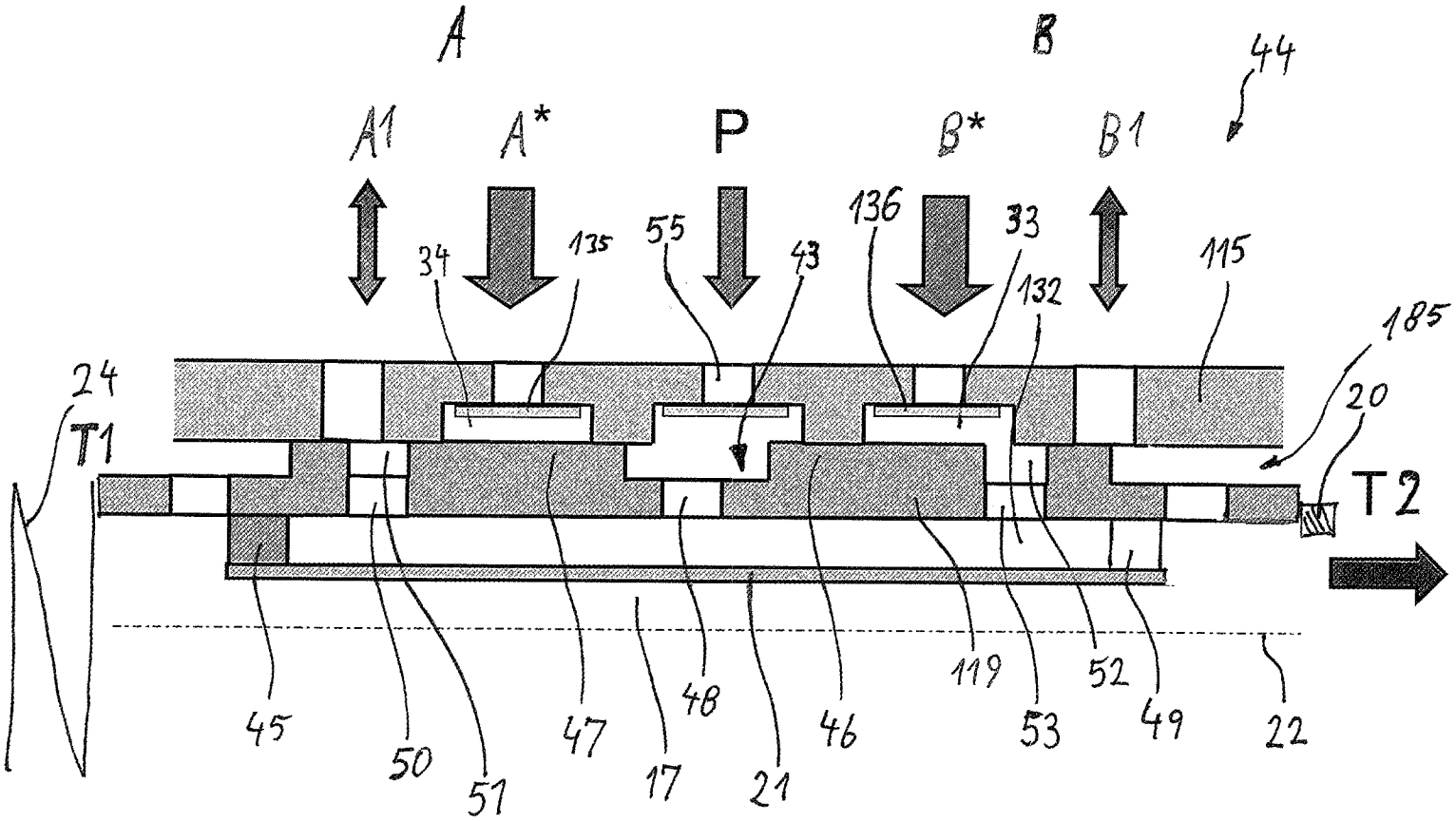
FIG. 3 shows in a half-section a second example embodiment of a hydraulic valve for adjusting the oscillating motor adjuster according to FIG. 1.

FIG. 3 shows a hydraulic valve 44 which also has a radial supply port P, but in FIG. 3 the supply port P lies axially between the two working ports A and B. This supply port P leads through boreholes 55 in a bush 115 from the oil pump (not shown in detail) of the internal combustion engine to an oil supply groove 43 in piston 119. This piston 119 is guided in an axially displaceable manner in a central borehole 185 of bush 115. In comparison to the previous example embodiment shown in FIG. 2, oil supply groove 43 divides the wide web of piston 119 into two webs 46, 47. From this oil supply groove 43, the hydraulic fluid is guided through boreholes 48 in the base of this oil supply groove 43 to a supply channel 132, which conducts the hydraulic fluid to the respective pressure chambers 9 or 10.

In contrast to the FIG. 2 embodiment, in the FIG. 3 embodiment, piston 119 is shown in the case of a disengaged electromagnetic actuator or tappet 20. In this case, piston 119 is found in the front position and conducts the hydraulic fluid through the first port part A1 to the first working port A. The associated second port part A* for utilizing the camshaft alternating torques is blocked by front web 47.

The other working port B is relieved of pressure through port B1 to the second tank outlet T2.

If the pressure increases abruptly within pressure chambers 10 as a consequence of camshaft alternating torques, then the excess pressure is guided to the second port part B* of the second working port B opposite supply channel 132 for opening a rear non-return valve 136. The hydraulic pressure is fed into supply channel 132 via an annular groove 52 and a borehole 53 in a base of the annular groove 52 and thus supports the rapid adjustment of rotor 8 opposite stator 1.

For this purpose, supply channel 132 runs inside piston 119, within which, however, a central channel 17 is also guided to the two tank outlets T1, T2. For this purpose, a tube 21 is inserted into piston 119, and rings 45, 49 are firmly pressed onto both ends of this tube. By means of these rings 45, 49, tube 21 is inserted immovably into piston 119, so that the two tank outlets T1, T2 are hydraulically separated from supply port P.

If piston 119 is relieved of pressure by the electromagnetic actuator via tappet 20, screw-type pressure spring 24 presses piston 119 into the rear position. In this state, which is not shown in the drawing, hydraulic fluid is conducted from the oil pump to the second port part B1 of the second working port B. As a consequence of camshaft alternating torques, the pressure is guided through the second port part A* of the first working port A and a front non-return valve 135 into an annular groove 51 in piston 119. Boreholes 50 are provided in the base of this annular groove 51, through which the hydraulic fluid is then fed into supply channel 132. Therefore, hydraulic fluid sufficient for a rapid adjustment of oscillating motor adjuster 14 is provided for by supply port P. The first working port A is relieved of pressure via the first port part A1 to the first tank outlet T1. Port B* is blocked by web 46.

Figure 4:
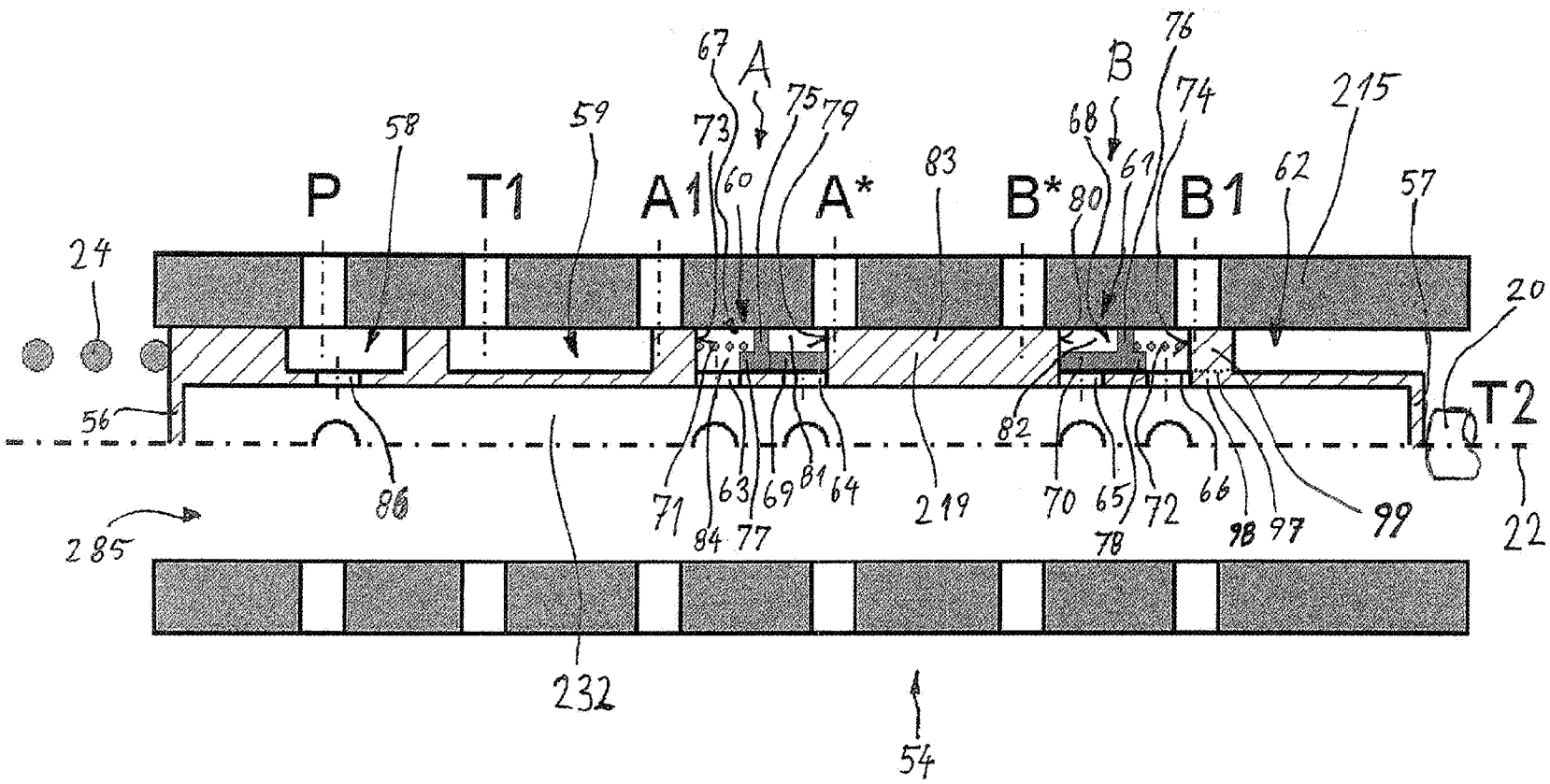
FIG. 4 shows in a half-section a third example embodiment of a hydraulic valve for adjusting the oscillating motor adjuster according to FIG. 1.

FIG. 4 shows in a half-section a third example embodiment of a hydraulic valve 54 for adjusting oscillating motor adjuster 14 according to FIG. 1.

The radial supply port P of hydraulic valve 54 is disposed at one end of a bush 215. Following this supply port P axially relative to one another, seen from front to back, are:

a radial tank outlet T1 the first radial working port A, and the second radial working port B.

A second tank port T2, in contrast, is found axially at the end of bush 215. The first working port A is further divided into the first port part A1 and the second port part A*. Likewise, the second working port B is further divided into the first port part B1 and the second port part B*.

A hollow piston 219 which is closed axially on both sides is disposed in an axially moveable manner in a central borehole 285 of bush 215. For this purpose, a screw-type pressure spring 24 is supported on one of its ends and a tappet 20 of an electromagnetic actuator is supported on its other end. Screw-type pressure spring 24 is applied to a wall 56 on the rear end of piston 219, whereas tappet 20 is applied to a wall 57 on the front end of piston 219. Piston 219 has five peripheral annular grooves 58, 59, 60, 61, and 62 that are axially distanced from one another. The annular groove 62 standing next to the electromagnetic actuator is open to the second tank outlet T2. The two annular grooves 60, 61 assigned to working ports A, B each have two boreholes 63, 64 or 65, 66, which are axially distanced from one another and which lead into supply channel 232 lying inside hollow piston 219. In each of the two annular grooves 60, 61 assigned to working ports A, B, there is disposed an annular, axially displaceable non-return valve 67, 68, which has a sleeve 69 or 70. These two sleeves 69 or 70 are each supported on piston 219 via a small screw-type pressure spring 71 or 72 on their sides not facing one another. For this purpose, one end of the respective screw-type pressure spring 71 or 72 is supported on the inner wall 73 or 74 of annular groove 60 or 61, which is assigned to port part A* or B* for utilizing the camshaft alternating torques. The other end of the small screw-type pressure spring 71 or 72 is supported on an annular piston 75, 76, which extends radially outward from sleeve 69, 70. A partial region 77 or 78 of sleeve 69 or 70, which extends in alignment through annular piston 75 or 76 axially out from sleeve 69 or 70 serves as a spring centering piece. As a consequence of the spring force, sleeve 69 or 70 is applied on the front side to the other inner wall 79 or 80 of annular groove 60 or 61. This inner wall 79 or 80 is consequently facing the first port part A1 or B1, which is allocated for the regular introduction and discharge of hydraulic fluid into pressure chambers 9 or 10. In the position of non-return valve 67 or 68, which is shown in FIG. 4, boreholes 64, 65 standing the closest next to one another in piston 219 of sleeve 69 or 70 are closed. An annular space 81 or 82 lying radially outside these boreholes 64, 65 is formed. If this annular space 81 or 82 is loaded with hydraulic pressure of sufficient level, then the respective borehole 64, 65 of the two boreholes 64, 65 placed the closest next to one another is released. In return, borehole 63 or 66 of the two boreholes 63, 66 placed far from one another is closed.

Both non-return valves 67, 68 open independently of one another against slight excess pressure from outside due to the respective second port part A* or B*. For this purpose, both non-return valves 67, 68 are separated from one another by means of a very wide web 83 of piston 19. This wide web 83 is bounded by inner walls 79, 80.

In the base of the frontmost annular groove 58 is provided a borehole 86, which conducts the hydraulic fluid from the supply port P into central supply channel 232. Between this annular groove 58 and annular grooves 60, 61 of working ports A, B, annular groove 59 is disposed, by means of which the hydraulic fluid is conducted from the first port part A1 of the first working port A to the first tank outlet T1, in the position of piston 219 shown in FIG. 4.

In the position shown in FIG. 4, piston 219 is found at the very back. In this case, the first port part B1 of the second working port B is supplied with hydraulic pressure by central supply channel 232 inside piston 219. The internal pressure in hydraulic valve 54 therefore supports the closing force of the rear non-return valve 68. In return, the hydraulic fluid is discharged from pressure chambers 9 assigned to the working port A via control groove 59 to the front tank outlet T1. If the pressure increases inside pressure chambers 9 assigned to this working port A as a consequence of camshaft alternating torques to above the pressure inside supply channel 232, then the front non-return valve 67 opens and the hydraulic pressure from pressure chambers 9 can be fed into supply channel 232 via boreholes 64. From there, the hydraulic fluid along with the hydraulic fluid coming from the oil pump is fed into the working port B via boreholes 66. The port B* in this case is closed by the wide web 83.

If piston 219 is shifted into the other position by means of tappet 20, then the hydraulic fluid is conducted to the first working port A. In this case, the hydraulic fluid flows from supply channel 232 through borehole 63 into an annular space 84, in which the small screw-type pressure spring 71 is disposed and then to the first working port A. In return, the hydraulic fluid is discharged from pressure chambers 10 assigned to the second port B via annular groove 62 to the rear tank outlet T2. If the pressure increases abruptly within pressure chambers 10 as a consequence of camshaft alternating torques to above the pressure inside supply channel 232, then the rear non-return valve 68 opens and the hydraulic pressure from these pressure chambers 10 can be fed into supply channel 232. From there, the hydraulic fluid along with the hydraulic fluid coming from the oil pump is fed into the working port A. The port B* in this case is closed by the wide web 83.

It is not absolutely necessary that both non-return valves 67, 68 according to FIG. 4 are designed in such a way that they are disposed in an annular groove 60 or 61 of piston 219 and in this case can be axially shifted opposite piston 219 against a spring force. It is also possible to design only one non-return valve 67 in an axially displaceable manner. In particular, if piston 219 is designed as a built-in piston 219, as is shown by the dotted line 97, only one non-return valve 68 needs to be inserted into annular groove 61, which is bounded by inner wall 74, which is disposed on a ring 99, which is pressed onto a tube-shaped region 98 of piston 119. In order to improve the joining without increasing the pressing forces on piston 219, a micro-serration can be provided, which can be similar to a knurling in appearance. In this case, sleeve 70 can be designed as a closed component.

Sleeve 69 or 70 may also be designed divided, however. Thus, it is possible to design the sleeve slotted, so that slotted sleeve 69 or 70 has a division. Then sleeve 69 or 70 can be bent at the slot, which is not visible in detail in the drawing, and can be moved via piston 219 until sleeve 69 or 70 snaps together with annular groove 60 or 61. Consequently, in this case, piston 219 does not need to be designed as a built-in piston 219. Plastic is of advantage as a material for the slotted sleeve in this embodiment. In particular, a thermoplastic with a small friction coefficient can be used opposite steel or aluminum. Plastic does not damage the running surfaces of piston 219 during assembly.

It is also possible, however, to divide non-return valve 67 or 68 in half. In this way, corresponding to FIG. 4, sleeve 69 or 70 can have a partial region 77 or 78, on which the two halves of a screw-type pressure spring 71 or 72 are held together.

It is also possible to design piston 219 as a built-in piston in which all annular grooves 58, 59, 60, 61 are formed by pressing on rings similar to ring 99.

The second example embodiment according to FIG. 3 shows that a connection is created between the two tank outlets T1, T2 by means of tube 21. Consequently, however, one tank outlet T1 or T2 can be omitted by means of this tube 21. This feature is then particularly of advantage when the discharge of hydraulic fluid is only possible in one direction due to the structural space conditions on the camshaft drive. For example, this is the case for a dry toothed belt, since a chain case is not provided here for conducting the hydraulic fluid into an oil sump. However, if the hydraulic fluid can be discharged on both sides, tube 21 can also be omitted and the piston can be closed on both sides.

In addition, the piston can still be adjusted in a central blocking position in which both working ports can be pressurized to a greater extent than the hydraulic fluid can be discharged. Thus, the oscillating motor adjuster is fixed in this angular position. Pistons 19, 119, 219 of the above-named embodiment examples are pressure-equilibrated.

Instead of the screw-type pressure spring for the piston or the screw-type pressure springs for the non-return valves, Belleville spring washers may also be used. The two port parts A1, A* or B1, B* assigned to one working port A or B must be separated when exiting from central borehole 85, 185, since piston 19, 119, 219 must introduce the hydraulic fluid separately. Outside the non-return valve, however, the two port parts A1, A* or B1, B* may be joined again. This reunification in fact may occur inside bush 15, 115, 215 or a rotor hub designed in one piece with the bush. Rotor 8 in an alternative embodiment can be prestressed torsionally elastically against stator 1 by means of a compensating spring.

The described embodiments only involve exemplary configurations. A combination of the features described for different embodiments is also possible. Additional features, particularly those which have not been described, for the device parts belonging to the invention can be derived from the geometries of the device parts shown in the drawings.

LIST OF REFERENCE CHARACTERS

1 Stator
2 Drive wheel
3 Stator base
4 Webs
5 Intermediate spaces
6 Vane
7 Rotor hub
8 Rotor
9 Pressure chambers
10 Pressure chambers
11 Channels
12 Central valve
13 Rotor channel
14 Oscillating motor adjuster
15 Bush
16 Hollow tube
17 Central channel
18 Camshaft
19 Piston
20 Tappet
21 Tube
22 Central axis
23 Through-borehole
24 Screw-type pressure spring
25 Through-borehole
26 Through-borehole
27 Through-borehole
28 Control groove
29 Control groove
30 Control groove
31 Control groove
32 Supply channel
33 Inner annular groove
34 Inner annular groove
35 Non-return valve
36 Non-return valve
37 Web
38 Recess
39 Recess
40 Recess
41 Recess
42 Wide web
43 Oil supply groove
44 Hydraulic valve
45 Ring
46 Rear web
47 Front web
48 Boreholes
49 Ring
50 Boreholes
51 Annular groove
52 Annular groove
53 Borehole

54 Hydraulic valve
55 Boreholes
56 Wall
57 Wall
58 Annular groove
59 Annular groove
60 Annular groove
61 Annular groove
62 Annular groove
63 Boreholes
64 Boreholes
65 Boreholes
66 Boreholes
67 Non-return valve
68 Non-return valve
69 Sleeve
70 Sleeve
71 Small screw-type pressure spring
72 Small screw-type pressure spring
73 Inner wall
74 Inner wall
75 Annular piston
76 Annular piston
77 Partial region
78 Partial region
79 Inner wall
80 Inner wall
81 Annular space
82 Annular space
83 Wide web
84 Annular space
85 Central borehole
86 Borehole
87 Stopper
88 Shoulder
89 Openings
90 Cross boreholes
100 Sieve
101 Non-return valve
102 Cross boreholes
103 Spring guide piece
115 Bush
119 Piston
132 Supply channel
135 Non-return valve
136 Non-return valve
185 Central borehole
285 Central borehole
215 Bush
219 Piston
232 Supply channel
285 Central borehole
A First working port
B Second working port
A1 First port part
A* Second port part
B1 First port part
B* Second port part
T1 First tank outlet
T2 Second tank outlet

The invention claimed is:

1. A hydraulic valve for an oscillating motor adjuster of a camshaft, comprising:

a piston inserted in a lengthwise displaceable manner in a borehole for distribution onto first and second working ports, a first port part of the first working port exiting the borehole for guiding hydraulic fluid into a first pressure chamber of an oscillating motor adjuster, a second port part of the first working port exiting the borehole for conducting the hydraulic fluid out from the first pressure chamber to a supply channel disposed inside the piston, a first port part of the second working port exiting the borehole for guiding the hydraulic fluid into a second pressure chamber of the oscillating motor adjuster directed opposite the first pressure chamber, a second port part of the second working port exiting the borehole for conducting the hydraulic fluid out from the second pressure chamber to the supply channel, two non-return valves disposed in a flow from the pressure chambers to each of the two second port parts, respectively, each non-return valve blocking the pressure in a direction from the supply channel pointing to the pressure chambers, wherein:

the piston, in a first position for introducing the hydraulic fluid from the supply channel into the first pressure chamber, blocks the second port part of the first working port which is assigned to the first pressure chamber; and the piston, in a second position for introducing the hydraulic fluid from the supply channel into the second pressure chamber, blocks the second port part of the second working port which is assigned to the second pressure chamber.

2. The hydraulic valve according to claim 1, wherein the first port part of the first working port, the second port part of the first working port, the first port part of the second working port, and the second port part of the second working port are each distanced axially from one another.

3. The hydraulic valve according to claim 1, wherein the two second port parts lie axially between the two first port parts.

4. The hydraulic valve according to claim 1, wherein the borehole is introduced centrally inside a bush that is designed separately relative to the camshaft and to a rotor of the oscillating motor adjuster.

5. The hydraulic valve according to claim 4, wherein the bush is designed as a central valve that is inserted radially inside the rotor.

6. The hydraulic valve according to claim 1, wherein:

the piston is hollow, the supply channel runs inside the piston, first and second recesses, which are axially distanced from one another, are provided in the piston, in the first position of the piston, via the first recess, hydraulic fluid from the second port part of the second working port via the supply channel through the second recess can be guided onto the first port part of the first working port, in the second position of the piston via the second recess, hydraulic fluid from the second port part of the first working port, via the supply channel through the first recess, can be guided onto the first port part of the second working port, a wide web by means of which the two second port parts can be blocked is provided axially between the two recesses.

7. The hydraulic valve according to claim 6, wherein the wide web is interrupted by a recess for introducing a supply pressure from the supply port into the supply channel.

8. The hydraulic valve according to claim 7, wherein a tube that is closed radially outward on both sides is inserted inside the piston, whereby inside of the tube, hydraulic fluid is guided to a tank outlet.

9. The hydraulic valve according to claim 1, wherein:

the piston can be displaced by means of an electromagnetic actuator against a force of a spring, and the non-return valves are strip-shaped and are applied in the base of inner annular grooves.

10. The hydraulic valve according to claim 1, wherein, arranged axially relative to the supply port in sequence are the following:

a first radial tank outlet, the first radial port part of the first working port, the second radial port part of the first working port, the second radial port part of the second working port, and the first radial port part of the second working port.

11. The hydraulic valve according to claim 1, wherein:

at least one of the non-return valves is disposed in an annular groove of the piston and can be axially displaced opposite the piston against a spring force.

12. The hydraulic valve according to claim 11, wherein the at least one of the non-return valves has a slotted sleeve with a division.

13. The hydraulic valve according to claim 12, wherein the slotted sleeve is composed of plastic.

14. The hydraulic valve according to claim 11, wherein the at least one of the non-return valves has a sleeve which is divided in half.

15. The hydraulic valve according to claim 14, wherein:

the sleeve has a partial region, on which the two halves of a screw-type pressure spring are held together, the pressure spring introduces the spring force.

16. The hydraulic valve according to claim 11, wherein:

the at least one of the non-return valves is inserted into an annular groove, the annular groove is bounded by an inner wall disposed on a ring, the ring is pressed onto a tube-shaped region of the piston.

* * * * *